United States Patent [19]

McGivern, Jr.

[11] Patent Number: 4,545,876

[45] Date of Patent: Oct. 8, 1985

[54] METHOD AND APPARATUS FOR SURFACE TREATING

[75] Inventor: James F. McGivern, Jr., Avon, Conn.

[73] Assignee: United Technologies Corporation, Hartford, Conn.

[21] Appl. No.: 606,056

[22] Filed: May 2, 1984

[51] Int. Cl.[4] ..... C25D 11/02; C25D 21/12; C25F 1/00

[52] U.S. Cl. ..... 204/130; 204/1 T; 204/58; 204/228

[58] Field of Search ..... 204/228, 58, 1 R, 1 T, 204/130, 129.02

[56] References Cited

U.S. PATENT DOCUMENTS

| | | | |
|---|---|---|---|
| 3,166,484 | 1/1965 | Hentz | 204/58 X |
| 3,592,754 | 7/1971 | Alhara | 204/228 X |
| 3,723,257 | 3/1973 | Bhattacharyya | 204/228 X |
| 4,100,036 | 7/1978 | Rode et al. | 204/228 X |
| 4,129,480 | 12/1978 | Robert | 204/228 X |
| 4,461,690 | 7/1984 | Rolff et al. | 204/228 |

FOREIGN PATENT DOCUMENTS

| | | | |
|---|---|---|---|
| 1496969 | 4/1969 | Fed. Rep. of Germany | 204/228 |
| 2016448 | 11/1971 | Fed. Rep. of Germany | 204/228 |
| 48-21699 | 6/1973 | Japan | 204/228 |
| 2069003 | 8/1981 | United Kingdom | 204/228 |

*Primary Examiner*—Donald R. Valentine

*Attorney, Agent, or Firm*—Robert E. Greenstien

[57] ABSTRACT

In a surface-treating process, such as anodizing, the current to each one of a plurality of treated articles is monitored separately, and if the current is above or below an acceptable current magnitude, the current to the article is interrupted, and an indication is also provided to identify that the current has been interrupted to the article. The acceptable current ranges are defined by a single calibration device which provides the same current reference control for each article.

8 Claims, 2 Drawing Figures

METHOD AND APPARATUS FOR SURFACE TREATING

DESCRIPTION

1. Technical Field

This invention relates to methods and apparatus for surface treating, which includes anodizing and electroplating.

2. Background Art

In anodizing, a well-known aluminum surface treating process, a current, preferably constant, is passed through a solution between an anode and a cathode over a controlled period of time to produce an aluminum oxide coating on the surface. The coating thickness is determined by controlling the current level and duration. Current density should be within certain ranges that are known. In hard-coat anodizing, for instance, the current is about 20–25 amperes per square foot. Processing time is roughly 90 minutes for developing a good oxide coating on the surface under those conditions.

For obvious economic reasons, large, or bulk, anodizing is used, and this usually consists of one common electrode (e.g., cathode for anodizing) in a single process medium bath and an electrode tree on which the articles are hung in the medium. The tree is connected to a common power supply, and the current flows through each article and in parallel with the other articles. The total current for the tree is held constant and is the product of the specified current density for the process and the total area of the articles in the tree. Yet, the current in each article is actually independent of the current in the other articles. Differences in current level from article to article can occur, and these can cause differences in the overall thickness of the coating from article to article. The current, for example, may be lower on one article than another because of the resistive effect of dirt on the article's surface, or electrode point contact resistance. The current in an article may be higher than another if a crack develops in the oxide surface during the process. This can occur at any time during the anodizing process if there is excessive heat dissipation in the coating. Similarly, new exposure of surface area due to masking changes also causes higher current.

DISCLOSURE OF INVENTION

According to one aspect of the invention, current in each article is sensed to determine if it is outside a predetermined acceptable range for the process, and if it is, the circuit connection to the article is automatically identified.

According to another aspect, the current in each article is sensed to provide a current level signal that manifests the current flow through the article. The sensing process is performed in such a way that substantially the same current in each article produces the same current level signal. A single pair of calibrated reference signals is employed to determine if that current level signal manifests that the current in the article is too high or too low. One signal represents the nominal desirable current through each article, the other an acceptable range beyond which the current is either too high or too low, necessitating interrupt of the processing of the article.

BEST MODE FOR CARRYING OUT THE INVENTION

Figure 1:
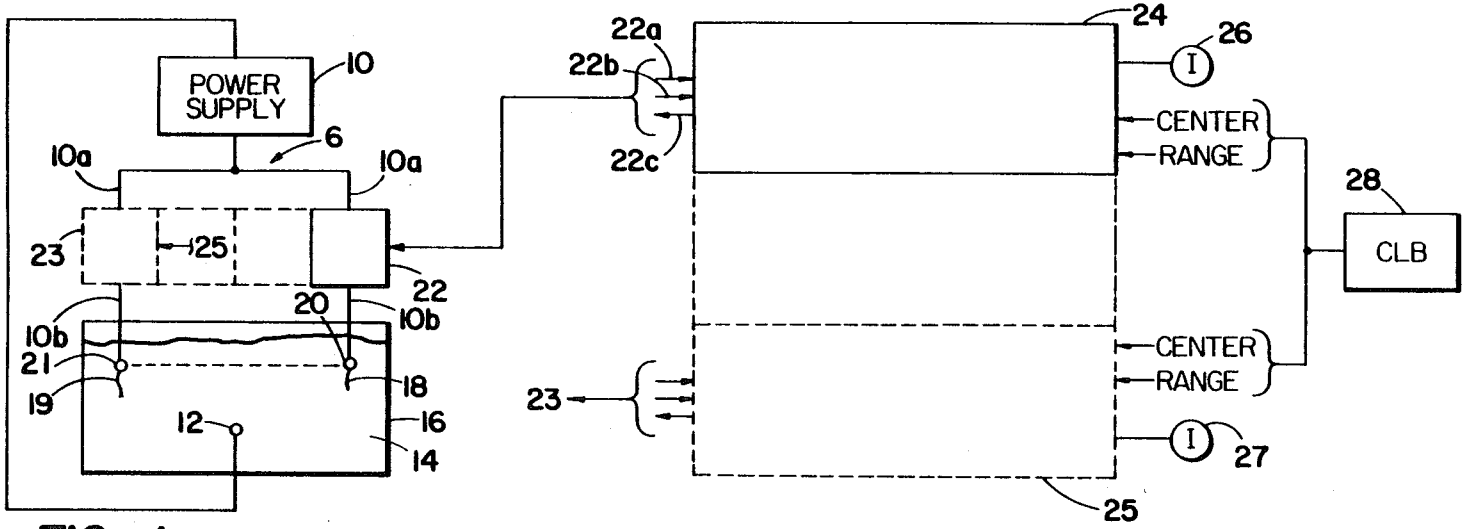
FIG. 1 is a functional block diagram of a surface-treating system embodying the present invention.

In FIG. 1 a common constant, selectable current power supply 10 has one of its outputs connected to a cathode 12 in an anodizing cell. This cathode is immersed in a processing solution 14 in a container 16. The container contains a plurality of articles 18,19 immersed in the solution, and each article is connected to an anode 20,21 that is part of an anode tree 6. The tree receives current from the power supply 10, and the current flows by a line **10*a* through a current sensing and interrupting device 22,23 (sensor device, hereafter), then through the line 10*b* and to the anode 20,21, and then to the article 18,19**.

The sensor device 22,23 is connected by three lines **22*a*, 22*b* and 22*c* to a processing control circuit 24,25 for the article, and an indicator device 26,27 (e.g., a lamp or bell) is connected to this control circuit. Using the sensor device, the control circuit senses the current flow through the article in the solution and compares the current level with preestablished current limits defining the maximum and minimum acceptable currents (determined by the surface area of the article) for the particular article and the treating process. If the article current is outside those limits, the control circuit provides a signal on the line 22*c***, causing the sensing device to interrupt the current flow through the anode to the article. At the same time, the indicator is also activated, providing a visible indication to the process operator that the current in that circuit has been interrupted and identifying this problem article.

For each article 18,19 in this particular embodiment, there is a dedicated sensor device 22,23 and a dedicated control circuit 24,25 and indicator 26,27, but the current limits for all the control circuits 24,25 are provided from the single calibration unit 28. That is, this one device provides the signals, "center and range", that indicate or establish the acceptable current levels. The same center and range signals are applied to each of the control circuits 24. These signals are selected with the calibration unit. The center signal defines the nominal process current for the article for its surface area, the range, an acceptable range (upper and lower limit) around that current. For this purpose, the calibration device may be a pair of potentiometers, one consisting of a calibrated thumbwheel control containing graduations corresponding to the acceptable center current or nominal current level; the second, a control with graduations for the acceptable range around the nominal level. This permits the processing operator to enter the correct current range and center (nominal) current levels for the different surface areas or different processes.

Figure 2:
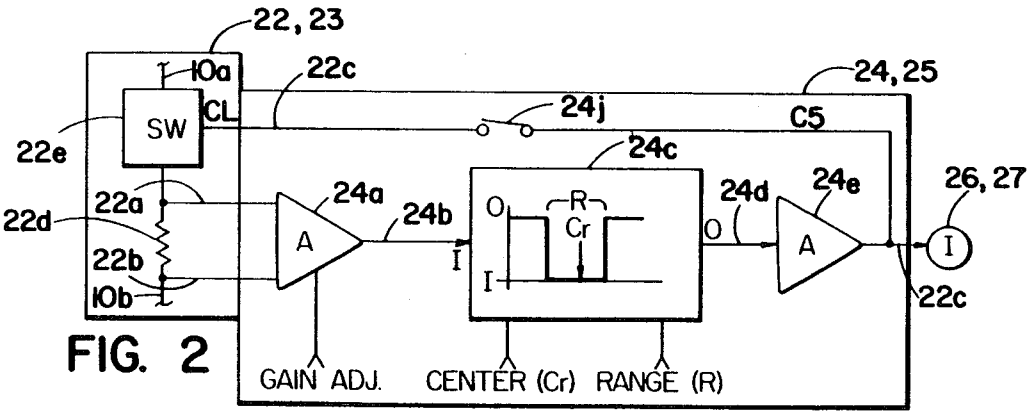
FIG. 2 is a functional block diagram of one of several current control devices that are used on the system illustrated in FIG. 1.

The block diagram comprising FIG. 2 shows one of the control circuits 24,25 and its corresponding sensor device 22,23 and the indicator 26,27. The sensing circuit contains a precision resistor **22*d* that is in series with the power supply and the anode. A precision resistor is used so that the resistance values in the anode circuit from article to article are nearly identical. In this way, the same current in each circuit will produce nearly the same voltage across the resistor. This makes it possible to use a single calibration circuit to provide the acceptable current limits for the process. The resistance value of the resistor 22d** should be as small as possible. During an anodizing process, the process operator typically monitors the anode-to-cathode voltage between the tree and the cathode according to an established voltage profile for the process to know when to stop the process. By minimizing the voltage drop across the resistor (e.g., to no more than a fraction of a volt), the voltage he sees is not discernibly altered and, therefore, the operator does not have to modify (interpolate) the correct voltage profile from the established one (without the resistor).

The voltage across the resistor 22d appears across the lines 22a and 22b, and these are supplied to the input of a differential amplifier 24a. This amplifier has adjustable gain for fine tuning the operation of the control circuit. This amplifier produces an output signal over the line 24b to the input of a window comparator 24c, which is a well-known device whose output voltage (O) on the line 24d changes state, either goes high or goes low, or vice versa, when the input (I) is beyond an acceptable range (R) around a center or nominal voltage (Cr). This transfer relationship is illustrated in the block that identifies the comparator 24c. The Cr and R voltages are supplied over separate lines, and this may be accomplished using known techniques, such as a potentiometer. In this instance, they are the "center" and "range" signals from the calibration circuit 28. Referring back to FIG. 1, the calibration circuit 28 provides these two "adjustments" to the circuits 24,25. For this purpose, a single pair of potentiometers can be used for all of the control circuits 24,25 to provide a common center and range adjustment for the articles 18,19 in the solution.

The comparator output, on the line 24d, is applied to the input of a buffer amplifier 24e that produces a control signal CS on the line 22c. This signal activates the indicator 26, and that occurs when the voltage drop across the resistor 22d is outside of the range R with respect to the center voltage Cr. The CS signal is also supplied, through a switch 24j, back to the sensor device 22, and there it is supplied to the control terminal CL of the switch 22e, causing the switch to operate (when the indicator also operates) if the switch 24j is closed. This opens the circuit between the power supply and the anode, interrupting current between the cathode and the anode through the article. Again, at the same time the indicator 26,27 provides a visual (or aural) indication. The process thus stops and the process operator can identify the problem article from the activated indicator.

An attractive feature of the invention is that it may be incorporated into older treating apparatus simply by breaking the circuit between the anode and the power supply and splicing the sensor circuit 22,23 in place along with their associated control circuits 24,25. Again, the resistor that is used should be low (approximately 0.1 ohms has been used in hard-coat anodizing) to avoid disturbing the voltage profile for the treating process. Stainless steel wire is recommended, as is nichrome, because they are durable and they can be physically trimmed to match the resistance between articles precisely. The invention plainly provides, for these reasons, an arrangement by which treating current in each anode-cathode circuit may be independently monitored without changing the basic treating process.

There is an alternative approach in using the invention. A single control circuit, e.g., control circuit 24, may be sequentially connected to the output across output lines 22a, 22b and 22c to each of the sensor devices 22,23. In other words, one control circuit may "scan" the articles to sense the voltage across their sensing devices 22,23. An arrangement like this would need a latching circuit to hold each indicator and switch in its current state as the scan is carried out.

From the foregoing, it can be seen that the invention provides an apparatus and method by which surface treating of a number of articles in a solution can be precisely controlled to avoid over and under current conditions and thereby decrease significantly defective surface treatment of individual articles. In addition to any described previously, other modifications and variations may be made by one skilled in the art to the foregoing without departing from the true scope and spirit of the invention.

I claim:

1. A surface treating method characterized by:

applying current to first and second articles in a treating solution;

providing a first preset signal that manifests the maximum acceptable individual treating current for the articles;

providing a second preset signal that manifests the minimum acceptable individual treating current for the articles;

sensing current in the first article to provide a first current signal which manifests a first particular magnitude current in the first article;

sensing the current in the second article to provide said first current signal for said first particular magnitude current in the second article;

using the first current signal for each article and the first and second preset signals to provide a current control signal for each article when the first current signal for the article is more than said maximum current or less than said minimum current;

monitoring for the presence of the control signal.

2. A method according to claim 1, further characterized by:

operating an indicator with the control signal.

3. A method according to claims 1 or 2, further characterized by:

operating a switch device with the control signal to interrupt the current through the article.

4. A surface treating system characterized by:

first and second electrode circuits for applying current to articles in a treating solution;

a power supply for providing said current to said electrodes;

first means associated with each electrode circuit for providing a first current signal in response to a particular current in the circuit;

second means for providing a first preset signal manifesting the maximum acceptable current for treating the articles;

third means for providing a second preset signal manifesting the minimum acceptable current for treating the articles;

indicating means associated with each circuit and operable by a control signal for the circuit;

switching means, associated with each circuit, for interrupting the current in the circuit in response to the control signal;

comparison means for receiving said first and second preset signals and individually receiving the first signal for each circuit and for providing the control signal associated with the circuit when said particular magnitude current is less than said minimum current or more than said maximum current.

5. A surface treating system according to claim 4, further characterized by:

said first means including a resistor in each circuit and means for sensing the voltage across the resistor, the resistors being matched to be within a tolerance that is less than or equals the maximum acceptable deviation in current from circuit to circuit for surface treating the articles.

6. A surface treating system according to claims 4 or 5, further characterized by switching means, associated with each circuit, for interrupting the current in the circuit in response to the switch control signal.

7. A surface treating system according to claims 4 or 5, further characterized by:

said comparison means including a window comparator responsive to the first and second preset signals and the first current signal for providing a signal to produce the control signal.

8. A surface treating system according to claim 7, further characterized by:

a switch for manually deactivating the switch means response to the control signal.

* * * * *